US007100809B2

(12) United States Patent
Arnold et al.

(10) Patent No.: US 7,100,809 B2
(45) Date of Patent: Sep. 5, 2006

(54) CARRYING BAG

(75) Inventors: Franc Arnold, Koblenz (DE); David Herold, Koblenz (DE); Björn Altenhofer, Trier (DE); Marcel Herrig, Ollmuth (DE); Lutz Scheffer, Pforzheim (DE)

(73) Assignee: RTI Sports Vertrieb von Sportartkeln, GmbH, Urmitz (DE)

( * ) Notice: Subject to any disclaimer, the term of this patent is extended or adjusted under 35 U.S.C. 154(b) by 346 days.

(21) Appl. No.: 10/647,100

(22) Filed: Aug. 22, 2003

(65) Prior Publication Data

US 2004/0124224 A1 Jul. 1, 2004

Related U.S. Application Data

(60) Provisional application No. 60/422,773, filed on Oct. 31, 2002.

(30) Foreign Application Priority Data

Aug. 23, 2002 (DE) ..... 102 38 694

(51) Int. Cl.
*A45F 3/04* (2006.01)

(52) U.S. Cl. ..... 224/604; 224/631; 224/641

(58) Field of Classification Search ..... 224/162, 224/604, 631, 637, 641, 254
See application file for complete search history.

(56) References Cited

U.S. PATENT DOCUMENTS 2,197,427 A * 4/1940 Despain ..... 224/635
3,198,300 A * 8/1965 Tuttle ..... 16/405
4,194,602 A * 3/1980 Allen ..... 224/578
5,114,059 A * 5/1992 Thatcher ..... 224/148.5
5,806,740 A * 9/1998 Carlson ..... 224/628
5,881,932 A * 3/1999 Wadden ..... 224/153
5,957,354 A * 9/1999 Mentken ..... 224/614
6,053,381 A * 4/2000 Fahl et al. ..... 224/153
6,070,776 A * 6/2000 Furnary et al. ..... 224/627
6,179,187 B1 * 1/2001 Lemire et al. ..... 224/640
6,375,053 B1 * 4/2002 Cecchinel ..... 224/267
6,394,328 B1 * 5/2002 Zakarin ..... 224/579
6,607,107 B1 * 8/2003 Dexheimer ..... 224/604

FOREIGN PATENT DOCUMENTS

DE 201 11889 U1 7/2001
EP 1 080 661 A1 7/2001

* cited by examiner

*Primary Examiner*—Stephen K. Cronin
(74) *Attorney, Agent, or Firm*—Ohlandt, Greeley, Ruggiero & Perle, L.L.P.

(57) ABSTRACT

A carrying bag, particularly a backpack, comprises a receiving container for receiving objects to be taken along, and a carrying device connected to the receiving container. The carrying device is decoupled in its movements from the receiving container by the provision of string lines which can be displaced in the direction marked by the arrows.

26 Claims, 2 Drawing Sheets

CARRYING BAG

CROSS-REFERENCE TO RELATED APPLICATIONS

This application is related to and claims priority in, German Patent Application No. 102 38 694.3, filed on Aug. 23, 2002, the contents of which is incorporated in its entirety by reference herein. This application is also related to and claims priority in, U.S. Provisional Application Ser. No. 60/422,773, filed on Oct. 31, 2002, the contents of which is incorporated in its entirety by reference herein

BACKGROUND OF THE INVENTION

The present invention relates to a carrying bag, particularly a backpack. Particularly if worn during sports activities, carrying bags such as backpacks have the disadvantage that, e.g. during movements of the wearer's shoulders, also the backpack itself or a storage bin of the backpack where objects have been stashed away for safekeeping, is moved along. Thereby, the wearing comfort, especially in case of sports activities such as mountain biking or climbing, is considerably affected.

Known from DE 201 11 889 is a backpack comprising a carrying device in the form of two shoulder straps, with each shoulder strap including a partial region of increased elasticity. By the provision of such elastic regions, it is to be accomplished that the backpack can be worn by different persons without the need to adapt the wearing system to the respective person. Further, in this manner, the backpack is given resiliency, thus effecting a resilient transmission of forces. However, in spite of the provision of the elastic partial regions, larger and faster movements as occurring e.g. during mountain biking or climbing, are transmitted to the backpack so that the backpack will move along and the wearing comfort will still remain considerably affected.

It is an object of the invention to improve the wearing comfort of carrying bags, particularly of backpacks.

According to the invention, the above object is achieved by the features of claims 1 and 14, respectively.

SUMMARY OF THE INVENTION

The carrying bag comprises a receiving container to accommodate objects which are to carried along. Connected to the receiving container is a carrying device such as e.g. one or a plurality of shoulder straps or shoulder belts. In the carrying bag of the invention, in order to reduce negative properties which are disadvantageous to the wearing comfort of backpacks and the like, the carrying device is with respect to its movements decoupled from the receiving container. This means that a movement of the body, e.g. of the shoulder, or a turning of the torso, will not at all or only slightly take along the receiving container of the inventive carrying bag. For instance, during mountain biking or climbing, the torso can be moved freely at least within certain ranges without causing the receiving container to be moved along. Thereby, the wearing comfort is considerably improved.

For improving the wearing comfort, the inventive carrying bag comprises a carrying device connected to the receiving container. The carrying device comprises upper and lower connection elements which can be connected e.g. to shoulder straps. Also, a shoulder strap can be used to form a combination of an upper and a lower connection element. According to the invention, the connection elements, which allow for a decoupling of movements, are provided with pulling elements. The pulling elements, which preferably are provided in the form of pulling strings, preferably steel strings or ropes, are arranged for displacement on the receiving container. Further, at least between two connection elements, a common pulling element is provided. A movement of the body which automatically leads to a movement of a connection element, will thus also cause a movement of a pulling element. Due to the connection to a second connection element, the movement of the pulling element will be transmitted to this second connection element. The distance between the two connection elements will therefore remain substantially constant. Thus, the invention is based on the recognition that the movement of a part of the human body, e.g. the lifting of a shoulder, normally results in a movement of another body part into another direction relative to the carrying bag. This means that e.g. the distance between the carrying bag and a shoulder strap is reduced on one side but at the same time is extended on the other side. This has the effect that, due to the provision of pulling elements, the corresponding movement will not be transmitted to the receiving container and that the receiving container is thus in its movements decoupled from the carrying device.

It is particularly preferred that only a sole common pulling element is provided. The upper and lower connection elements are thus connected to each other by a sole pulling element or are formed as a sole pulling element. Thus, for instance, the pulling element extends between the shoulder straps and the receiving container. In this regard, the wearing comfort can be further improved if the sole common pulling element is closed in itself. The common pulling element thus extends e.g. from one connection element or one shoulder strap in the region of the wearer's back to the receiving container, is held for displacement on the receiving container and extends, in the region of the hip, towards the front to the second shoulder strap. From the latter, the pulling element extends again on the wearer's back to the receiving container where it is arranged for displacement, and is guided from the receiving container towards the front up to the first shoulder strap. Particularly, the pulling element is held for displacement also on the shoulder straps.

A special advantage of the inventive decoupling of movements between the receiving container and the carrying device resides in that, particularly when carrying larger weights and/or while performing stressful sports activities, the user's fatigue will be reduced. Further, the inventive decoupling of movements makes it possible to obtain a better distribution of weights.

In a preferred embodiment, the two lower connection elements, i.e. those connection elements which are connected e.g. to the front or rear ends of the shoulder straps or the like, are formed by a common pulling element. Thus, in this embodiment, the pulling element which particularly is provided as a pulling string, is tightly connected to the front end of a shoulder strap, is then guided—preferably through a channel or a guide member—on the receiving container, and is then connected to the front or lower end of the second shoulder strap. Via the pulling element, the movements of the two lower ends of the shoulder straps are coupled to each other. Thereby, a pulling movement acting on one end of the pulling string, i.e. an enlargement of the distance between the front end of the shoulder strap and the receiving container, will simultaneously effect a reduction of the distance between the front end of the other shoulder strap and the receiving container. This provision of a common pulling element represents a technically straightforward solution for realizing a decoupling of movements between the carrying device and the receiving container. The need for a complex wind-up device for a tensioned pulling element and the like is obviated. Further, this embodiment offers the significant advantage that the decoupling of movements is independent from the weight of the receiving container which may heavily vary, depending on the objects to be transported. In case of wholly elastic connection elements, a decoupling of movements can be realized only within certain weight limits. If possible, also the pulling element or parts thereof can have a certain elasticity.

In a further preferred embodiment, upper connection elements are provided which are preferably connected to rear ends of shoulder straps, i.e. to the ends of the shoulder straps arranged on the user's back. In the first embodiment, these connection elements are preferably elastic. The upper connection elements can be provided in place of the lower connection elements or in addition to them.

In a preferred inventive embodiment of the upper connection elements, these elements are connected to the receiving container via an intermediate element so that the upper connection elements together with the intermediate element form a Y-shaped structure.

According to a further embodiment, for realizing a decoupling of movements in this region, the upper connection elements, in addition to their elasticity or instead of the latter, can be connected via a turning element to the receiving container. Preferably, in this case, the turning element is centrally connected to the receiving container through a sole intermediate element. Thus, whenever the user moves his or her upper torso back and forth, this movement is deflected via the turning element and will not cause a movement of the receiving container so that the wearing comfort is improved by the provision of the turning element.

Further, the possibility exists to connect two or more bags via turning elements. The individual bags can thus be turned relative to each other, thus allowing for a relative movement between the bags in the manner of chain links or the like. Thus, it is also effected that a movement of the user's body will not—or at the most slightly—cause the bags, particularly the backpacks, to move along, resulting in an improved wearing comfort.

In a particularly preferred embodiment of the upper connection elements, also these comprise a common pulling element which, if desired, can also be elastic. This common pulling element is preferably connected to the two rear ends of the shoulder straps. Preferably, the common pulling element is guided via a deflection element for guidance of the common pulling element. In this case, the deflection element can be connected to the receiving container, preferably centrally, via a sole intermediate element. In such an arrangement, the intermediate element is connected to the receiving container most preferably at a distance from an inner side, i.e. a back-abutment face, of the receiving container. This has the advantage that the upper connection elements, possibly along with the turning element, the common string line and/or the deflection element, will not be in abutment on the user's back, thus further improving the wearing comfort, and that a rubbing of these elements on the back and perspiration under these elements are avoided.

The provision of a common pulling element in the lower connection elements as well as in the upper connection elements can be realized such that the pulling element is arranged between the two respective connection elements and that the channel and the guide element, respectively, are provided on the bag. This arrangement can also be reversed so that a string or the like is provided on the bag and a common channel or a common guide element is provided between two connection elements. What is relevant is the possible relative movement between the channel or guide member and a pulling element. Further, the possibility exists to arrange the pulling elements or channels in a crosswise configuration so that each time a lower connection element is connected to an upper connection element. The pulling elements can be provided in the form of continuous string lines, strings, bands, chains and the like. Further, it can be provided that a common string line comprises an intermediate element, e.g. a load, between straps or the like.

Guidance of the string line or the like is performed either within a channel which can be formed as a closed channel corresponding to a tube or the like, or within an open or partially open channel. Also other guide members, such as loops, eyelets or Bowden-cable-type outer sleeves, can be provided.

In a further preferred embodiment, the upper pulling element is connected not to the shoulder strap or the shoulder cushioning pad but to the lower string line. Thus, the pulling element is held for displacement on the shoulder strap. For this purpose, the shoulder strap or the shoulder pad has connected thereto a channel, eyelets or the like for guidance of the pulling element. By this preferred embodiment of the inventive carrying bag, a further decoupling between the receiving container and the carrying device is realized. By this modification, a sliding of the shoulder straps or shoulder pads on the shoulder, as might be caused by the user's movements, is avoided.

It is particularly preferred that the lower and upper pulling elements are provided in the form of a sole pulling element. In a modification of the above embodiment, this pulling element is a pulling element which is closed in itself. Preferably, this pulling element extends from a shoulder region downwards to the hip, is then guided—through the channel connected to the receiving container—from one side to the other side of the hip substantially at hip level, is then arranged to extend from the hip upwards again to the other shoulder and from there, along a U-shaped path, to the first shoulder via the deflection element connected to the receiving container. Thus, the string line is substantially configured in the shape of a double "U".

In a further preferred embodiment, there is again provided a sole pulling element closed in itself, such as a string line, which has the receiving container movably connected thereto. A substantial basic principle of both preferred embodiments resides in the provision of a pulling element which is closed in itself while moveably connected to the receiving container or held for displacement thereon.

In a further preferred embodiment, the pulling element preferably extends from one shoulder downwards to the hip, i.e. in the front of the body, is guided there by a channel or the like provided on the receiving container and then, in the region of the back, extends from one hip obliquely upwards to the other shoulder. From this shoulder, the pulling element extends downwards to the other hip and is again guided by a channel or the like connected to the receiving container and then, in the back region, is guided obliquely upwards to the first shoulder. Thus, in this embodiment, the pulling element intersects itself in the back region. In this particularly preferred embodiment, a complete decoupling of movements is realized between the receiving container and the carrying device. This embodiments does not only allow for movements of the shoulders or a bending of the upper torso to the left or the right without an accompanying movement of the receiving container, but even for movements of the upper torso in the forward and rearward directions. By the inventive arrangement of the pulling element closed in itself, no more than a very slight adjustment will be required. Thus, e.g. after mounting a bicycle, the position of the backpack need not be newly adjusted although the orientation of the upper torso will then be considerably different from the orientation e.g. during walking. Thus, an automatic adjustment to the movement or type of movement of the body is performed. The one or plurality of pulling elements, which are preferably provided as string lines after the fashion of a Bowden cable or the like, are preferably made from a low-friction material or have a low-friction surface. Pulling elements or string lines made from nylon and/or metal are particularly useful. These can be provided e.g. with a silicone cover or a Teflon cover to further reduce the friction.

Further, the channels, eyelets and the like which are arranged on the receiving container or the shoulder straps, can be provided with suitable features to reduce the friction.

Preferably, these elements are provided or coated with a material having a low-friction surface. Such material can be a Teflon or silicone coating. Further, a permanent lubrication can be provided in addition to a coating or instead of it.

Since parts of the pulling element or pulling elements extend externally of channels or other holding devices provided on the receiving container, these parts are preferably provided with a cover. Given the movements which will occur between the string and the receiving container, the preferably added covering means are preferably of a variable type. This can be accomplished by the provision of elastic covering means and/or multi-part covering means which are e.g. adapted to be telescoped into each other.

It may happen that, in case of specific movements, the wearer of the carrying bag wishes to reduce or even completely eliminate the decoupling of movements. Preferably, for this purpose, an adjustment element is provided which is connected to the pulling element. The adjustment element can be e.g. an adjustable spring or the like, arranged to exert pressure on the pulling element and thus to increase the pressure on this site. The adjustment element can also be a clamping means by which the decoupling of movements between the receiving container and the carrying device can be switched on and off.

It is particularly preferred that the entry of the pulling element into a channel or the like occurs on the side of the user's body opposite to the side of the exit of the pulling element from the channel or the like. For instance, the pulling element or elements are arranged to enter corresponding channels in the shoulder region on the side of the user's back while the pulling element or elements will exit from channels or the like in the hip region on the front side, i.e. in the user's belly region. In this manner, a further improvement of the decoupling of movements can be achieved.

In conventional backpacks, to be able to adapt the carrying device to the anatomy of the user, the two shoulder straps are each provided with an adjustment strap portion. The two adjustment strap portions have to be adjusted separately from each other so that a uniform adjustment will be possible only on an intuitive basis. By the inventive provision of a pulling element, particularly a sole pulling element closed in itself and adapted to be displaced relative to the shoulder straps, it is possible to provide a sole pulling strap portion or adjustment strap portion since such a strap portion will automatically effect a shortening on both sides. The two sides are thus always set in an identical manner. With only one adjustment strap portion required in the inventive carrying bag, also a single-handed operation is possible, which is advantageous particularly when riding a bicycle.

Further, the decoupling of movements can be performed by the provision of variable-length connection elements whose length will self-adjust or automatically adjust in case of movements. Thus, according to the invention, the wearing system will follow the movements of the body. In the invention, for this purpose, the carrying device and the receiving container have—at least partially—connecting elements provided therebetween whose length will vary or adapt itself in case of movements. This can be obtained by elastic connection elements which are preferably arranged between the carrying device and the receiving container. According to the invention, in a backpack with two shoulder straps, respective connection elements are provided preferably between the front ends of the shoulder straps, i.e. the ends arranged in the chest and belly region, and the receiving container, as well as between the rear ends of the shoulder straps, i.e. the ends arranged on the user's back, and the receiving container. Particularly, the connection elements provided between the front ends and the receiving container are elastic or extensible. Further, it is particularly preferred that the connection elements between the rear ends and the receiving container are elastic.

Elasticity of the connection elements can be realized by corresponding materials such as rubber. Further, spring elements and the like can be provided. Further, an elastic connection element can be provided as a string adapted to be wound up, wherein, for instance, a spring will be tensioned when the string is wound off so that the string, once it is relieved, will be wound up again, thus reducing the length of the connection element.

In addition to, or instead of, the provision of variable-length connection elements, the bag itself can have a certain elasticity. For instance, the bag can be wholly or partially consist of an elastic material so that e.g. a movement of the shoulder will cause an extending of the length of the bag.

The receiving container is preferably arranged at hip level. This has the advantage that the weight of the backpack or the carrying bag is not located on the back, i.e. in that region which is undergoing strong movements. Further, the arrangement of the receiving container in the region of the hip safeguards a venting effect on the user's back and thus a reduction of perspiration or an improved evaporation of perspiration. Still further, this arrangement of the receiving container advantageously effects a favorable weight distribution.

A further possibility for the decoupling of movements which can be provided in addition to, or in place of, the above described decoupling of the shoulder straps, is the provision of a hip belt arranged in tight abutment with the body and having the receiving container fastened thereto through a joint, particularly a ball joint. Thus, the receiving container can be pivoted at about an axis extending substantially orthogonally to the user's back or vertically to the hip belt. This makes it possible that the upper torso can be pivoted without causing an accompanying displacement of the hip belt.

According to an independent invention, there is provided a carrying bag, such as a backpack, comprising a receiving container and a carrying device connected to the receiving container. The carrying device comprises upper and lower connection elements. According to the invention, at least two connection elements are connected to each other by a string line, particularly a Bowden cable or the like, with the string line being made from a material having a low-friction surface. Already by the provision of a smooth-running string line between the connection elements, the wearing comfort can be improved.

The string line, as described above in a general manner with reference to a pulling element, has advantageous features. Particularly, a channel or the like which is optionally arranged on the receiving container, is also provided with a low-friction surface. This surface can comprise suitable coatings or particularly be made from hard plastic, metal and/or Teflon.

The inventive principle of the above motion-decoupled wearing system is not restricted to carrying bags and particularly backpacks. Further, in place of the receiving container, any desired other object, such as a lifesaving jacket, a bulletproof vest or the like can be provided. In such carrying devices, the receiving container is thus replaced by the object to be carried along or by the carrying element. In principle, the inventive wearing system is suited for any kind of loads, e.g. is useful also for the carrying of musical instruments, weapons, remote control devices, gas bottles and the like, oxygen bottles for diving, or also tools. Further, due to the inventive decoupling of movements, the wearing system is also well-suited for child-carrying racks or special pieces of clothing, such as bras or suspenders. Also back and shoulder protective apparel can be connected to the inventive wearing system and thus be worn in a more convenient manner.

The invention will be explained in greater detail hereunder in connection with preferred embodiments thereof with reference to the attached drawings.

DETAILED DESCRIPTION OF PREFERRED EMBODIMENTS

Figure 2:
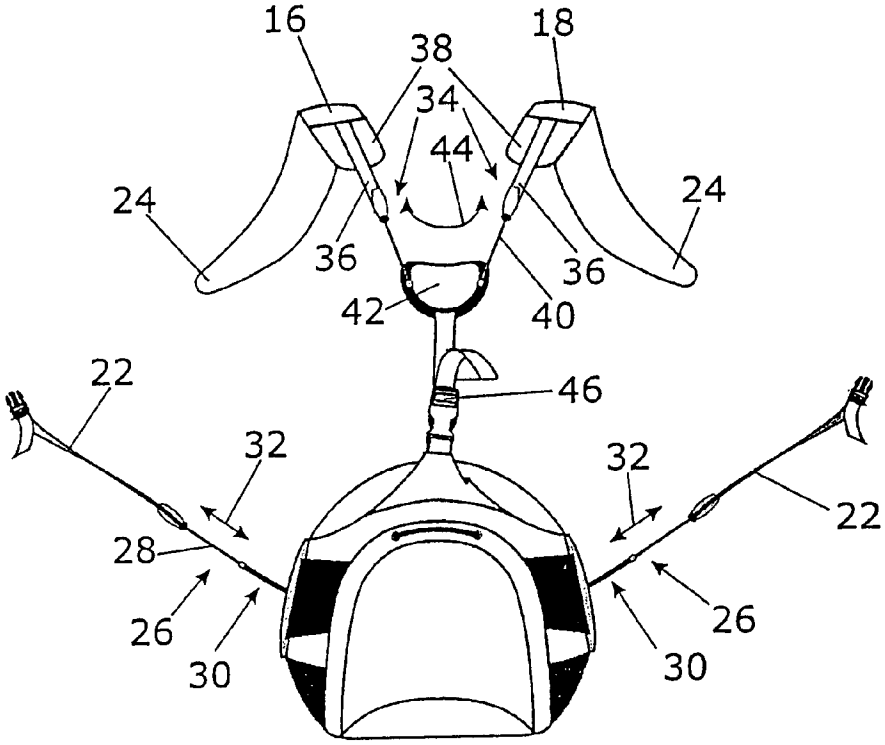
FIG. 2 is a schematic rear view of the backpack illustrated in FIG. 1.

The backpack of the invention comprises a receiving container 10 provided for accommodating objects therein which are to be taken along. The receiving container 10 is arranged at the user's hip level and is held on the hip by means of a hip belt 12. Further, the backpack comprises a carrying device 14; the hip belt 12 does not form part of the carrying device 14.

In the illustrated first preferred embodiment, the carrying device 14 comprises two shoulder straps 16,18 which can connected to each other, such as by a chest strap 20. Thus, the shoulder straps 16,18 are kept in tight abutment on the user's body. Front ends 24 of the shoulder straps 16,18 are connected to connection elements 26 by means of intermediate elements 22 which can be adjustable in length and be provided in the form of belt straps. The connection elements 26 are connected to the receiving container 10. In the illustrated embodiment, the connection elements are provided, for use as a common pulling element, with a string 28 which is arranged as a Bowden cable and is guided through a tubular Bowden cable sleeve 30. Thus, the Bowden cable sleeve 30 forms a channel or a tube connected to the receiving container 10 and provided for movement of the string line 28 therein. The Bowden cable sleeve 30 is fixedly connected to the receiving container 10. Thus, the string line 28 can be moved back and forth in the Bowden cable sleeve in the directions marked by the arrows 32. Since the two intermediate elements 22 are coupled to each other by the common string line 28, a movement of one intermediate element into one direction will automatically effect a movement of the other intermediate element in the other direction. This corresponds to the user's natural sequence of movements since, e.g. during a bicycle ride or mountain climbing, both shoulders will not be lifted simultaneously; the user will instead normally carry out movements which are opposed to each other. This is the case e.g. also when turning the upper torso.

Further, apart from the lower connection elements 26, the backpack of the invention also comprises upper connection elements 34. The connection elements 34 are connected to the rear ends 38 of the two shoulder straps 16,18, optionally through intermediate elements 36. In the illustrated embodiment, the connection elements 34 are provided, for use as a pulling element 40, with a common string line guided on a deflection element 42. The string line 40 is connected to the two intermediate elements 36. Also the deflection element comprises a channel or a Bowden cable sleeve having the string line guided therethrough. Corresponding to the movement described with reference to the lower connection elements 26, a movement of the intermediate element 36 or one of the two shoulder straps 16,18 into one direction, e.g. upwards, causes a movement of the respective other intermediate element or shoulder strap into the other direction, e.g. downwards, thus effecting a movement of the string line 40 in the direction of arrow 44.

The deflection element 42, being part of the connection elements, is connected to the receiving container 10 through a further component of the connection elements, notably through an intermediate element 46 which can be a belt with buckle. In this regard, the attachment point 48 between the intermediate element 46 and the receiving container 10 is provided at a distance from an inner side 50 of the receiving container. The inner side 50 is the back abutment face where the receiving container 10 rests on the user's back. By the distance of the attachment point, it is safeguarded that the upper connection elements 34 will not abut on the user's back.

Figure 3:
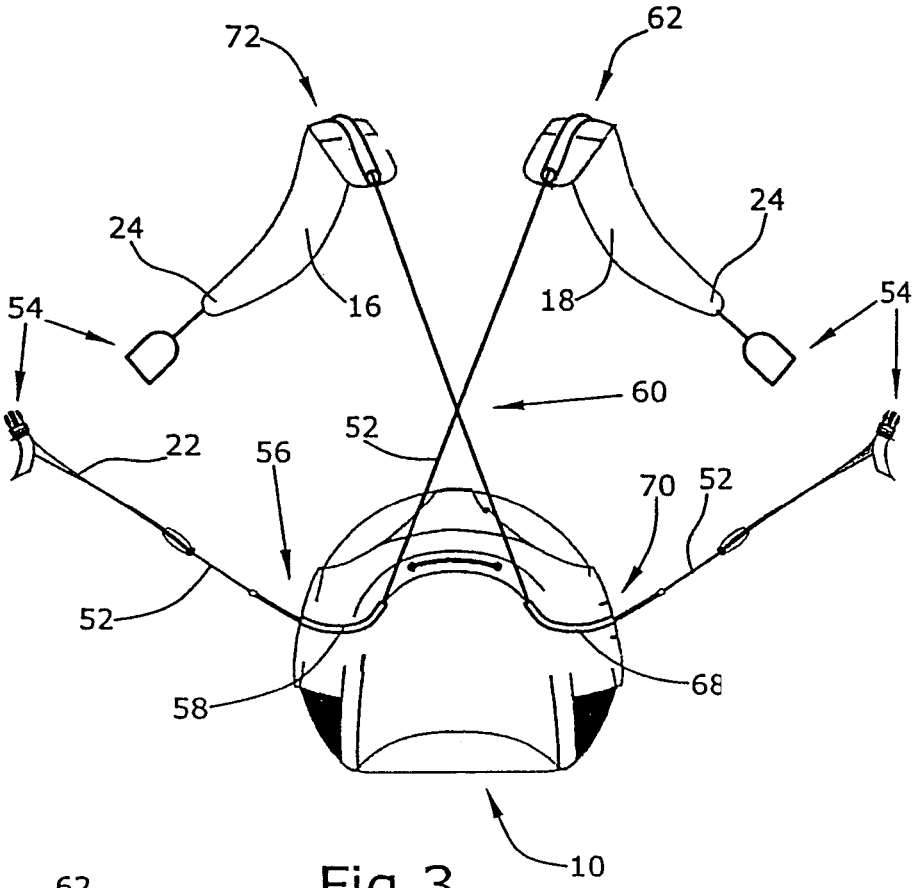
FIG. 3 is a schematic rear view of a second preferred embodiment of a backpack.

In the description of a second preferred embodiment (FIG. 3), identical and similar components are provided with the same reference numerals.

The essential difference in this embodiments resides in the provision of a string line which is closed in itself, i.e. the lower string line is joined to the upper string line to form one common pulling element or string line 52. Of course, in this case, the string line need not be uniform. For instance, the string line can have strap-like intermediate elements 22 and connection elements 54 as described with reference to the first embodiment. What is relevant is the existence of a string line closed in itself or a string element closed in itself while the backpack is worn. In the left hip region 56 according to FIG. 3, the string line 52 is guided through a channel 58 which in the illustrated embodiment is arranged on the outer side of receiving container 10. Thereafter, the string line 52 is guided upwards, and in the region 60 of the back, it extends diagonally upwards, i.e. in FIG. 3 from the lower left to the upper right, to a shoulder region 62.

Figure 6:
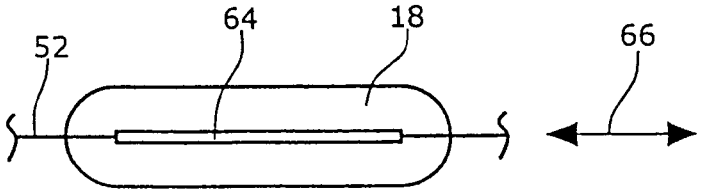
FIG. 6 is a schematic plan view of a preferred embodiment of a shoulder strap and a shoulder pad.

The shoulder pads or shoulder straps 16,18 are different from the shoulder straps 16,18 described with reference to FIG. 2 in that the string line 52 is not tightly connected to the shoulder pads 16,18 at the rear ends 38 (FIG. 2); instead, the shoulder pads 16,18 are connected to a channel 64 (FIG. 6). Channel 64, which can be provided in the form of individual eyelets or the like, extends in the longitudinal direction of the shoulder pad 16, i.e. over the shoulder. The string line extends through channel 64 and is freely movable within the channel in the direction marked by arrow 66. Thus, when the string line 52 is moved within channel 64, the shoulder pad 16,18 will not be displaced.

At the front end 24 of the shoulder pad 18, the pulling element or the string line 52 is guided downwards and in the illustrated embodiment is provided with a connection element 54. Alternatively, however, the string line 52 can be continuous. By the connection of the two connection elements 54 on both sides, the string line 52 is again closed in itself and extends to the right-hand hip according to FIG. 3. In this region, the string line 52 is again guided into a channel 68 or a corresponding element. The string line 52 is arranged to extend through the complete channel 68. After emerging from channel 68, the string line 52 is guided from the right-hand hip region 70 according to FIG. 3 to the left shoulder region 72. Thus, in the region of the back, the string line 52 extends again diagonally so that the string line 52 will intersect with itself in the back region 70. Then, the string line 52 is guided over the shoulder pad 16. The shoulder pad 16 is configured according to the shoulder pad 18 shown in FIG. 6 so that the string line 52 is guided through a channel 64 of shoulder pad 16 and is connected to a connection element 54 in the region of the lower end 24 of the shoulder pad. By closing the connection elements 54, the string line 52 will then be closed in itself.

Figure 5:
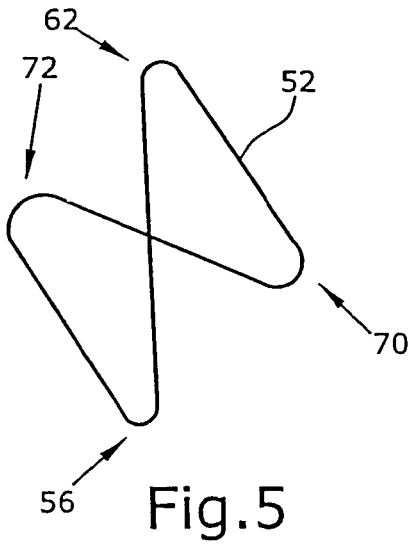
FIG. 5 shows a schematic representation of another course of the string line.

For clarification, the course of the string line 52 is shown in FIG. 5 without the receiving container 10 and without possible intermediate elements in the string line.

Figure 1:
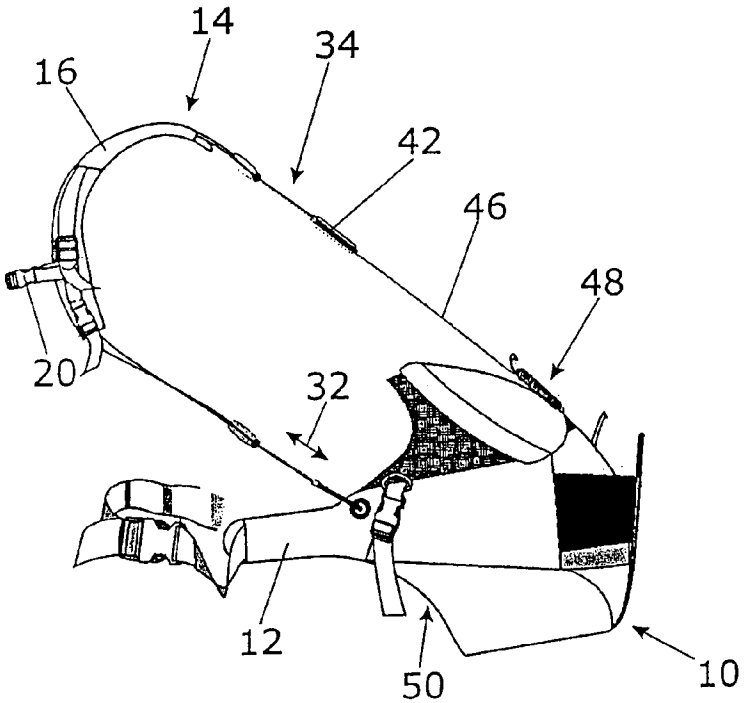
FIG. 1 is a schematic side view of a first embodiment of a backpack.
Figure 4:
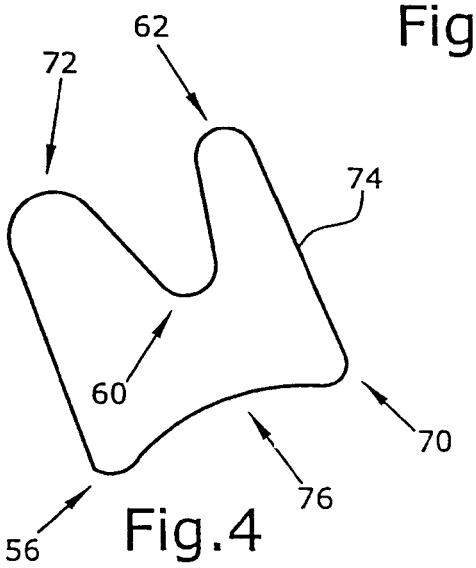
FIG. 4 shows a schematic representation of a course of the string line.

Further, the shoulder pad 18 illustrated in FIG. 6 can be provided also in the embodiment described with reference to FIGS. 1 and 2. In this case, the upper string line 40 (FIG. 2) is not tightly connected to the shoulder pads 16,18 but is also guided through a channel 64 (FIG. 6). The string line is then connected to the intermediate elements 22 (FIG. 2) by means of connection elements. In this manner, too, a string line closed in itself is formed, as schematically shown in FIG. 4. Such a string line 74 extends from the shoulder region 72 downwards to the hip region 56, then extends in a region 76 along the hip—in the illustrated embodiment from left to right—to the second hip region 70. From there, the string line 74 is then guided to the other shoulder region 62. Thereafter, the string line 74 extends, in the region 60 of the back, along a U-shaped path from one shoulder region 62 to the other shoulder region 72 via a deflection element (not shown).

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

The invention claimed is:

1. A carrying bag, particularly a backpack, comprising a receiving container for receiving objects to be transported, and a carrying device connected to the receiving container and comprising connection elements, the connection elements being upper and lower connection elements, wherein the connection elements comprise pulling elements held displaceably on the receiving container, at least two of the connection elements comprising a common pulling element, wherein movement of one of the at least two of the connection elements of the common pulling element causes movement of another of the at least two of the connection elements of the common pulling element, wherein a deflection element is provided for guidance of the common pulling element, wherein the deflection element is laterally movable relative to the common pulling element and wherein the carrying device is movable relative to the receiving container.

2. The carrying bag according to claim 1, wherein the upper connection elements comprise the common pulling element extending from one of the connection elements via the receiving container to another of the connection elements.

3. The carrying bag according to claim 1, wherein the lower connection elements comprise the common pulling element extending from one of the connection elements via the receiving container to another of the connection elements.

4. The carrying bag according to claim 1, wherein the pulling element is formed as a string line.

5. The carrying bag according to claim 1, wherein the connection elements or the pulling element is variable in length.

6. The carrying bag according to claim 1, wherein the carrying device comprises two shoulder straps each having front ends connected to the receiving container respectively via the lower connection elements.

7. The carrying bag according to claim 1, wherein the upper connection elements are connected either to the receiving container or via an intermediate element at a distance from an inner side of the receiving container.

8. The carrying bag according to claim 1, wherein the carrying device is connected to the receiving container in a detachable manner.

9. The carrying bag according to claim 1, wherein the receiving container is disposed substantially at hip level.

10. The carrying bag according to claim 1, wherein the pulling element is made from a material having a low-friction surface.

11. The carrying bag according to claim 10, wherein the material for the pulling element is selected from the group consisting of: nylon, metal and combinations thereof.

12. The carrying bag according to claim 1, wherein the pulling element is guided through a channel provided on the receiving container.

13. The carrying bag according to claim 12, wherein the channel has a low-friction surface.

14. The carrying bag according to claim 13, wherein the low-friction surface is selected from the group consisting of: hard plastic, metal, Teflon, low-friction coatings, and combinations thereof.

15. The carrying bag according to claim 1, wherein the carrying device comprises shoulder straps on the rear ends of which the respective upper connection element are connected to the receiving container.

16. The carrying bag according to claim 15, wherein the two upper connection elements are guided to join each other together with an intermediate element in a Y-shaped configuration.

17. The carrying bag according to claim 15, wherein the upper connection elements are connected to the receiving container by a turning element.

18. The carrying bag according to claim 1, wherein a sole common pulling element is provided.

19. The carrying bag according to claim 18, wherein the sole common pulling element is closed in itself.

20. The carrying bag according to claim 18, wherein the sole common pulling element extends from one of the upper connection elements to one of the lower connection elements, from the one of the lower connection elements to another of the upper connection elements, from the another of the upper connection elements to another of the lower connection elements, and from the another of the lower connection elements back to the one of the upper connection elements.

21. The carrying bag according to claim 20, wherein the sole common pulling element intersects with itself in the region of the back.

22. The carrying bag according to claim 21, wherein the common pulling element of the upper connection elements is connected to two rear ends of shoulder straps.

23. The carrying bag according to claim 22, wherein the deflection element has a groove that allows the common pulling element to slide therein.

24. A carrying bag, particularly a backpack, comprising a receiving container for receiving objects to be transported, and a carrying device connected to the receiving container and comprising connection elements, the connection elements being upper and lower connection elements, wherein the connection elements comprise pulling elements held displaceably on the receiving container, at least two of the connection elements comprising a common pulling element, wherein a sole common pulling element is provided that extends from one of the upper connection elements to one of the lower connection elements, from the one of the lower connection elements to another of the upper connection elements, from the another of the upper connection elements to another of the lower connection elements, and from the another of the lower connection elements back to the one of the upper connection elements, wherein the sole common pulling element intersects with itself in the region of the back, wherein the common pulling element of the upper connection elements is connected to two rear ends of shoulder straps and wherein shoulder pads are provided that have a channel formed therein for guiding the pulling element therethrough.

25. A carrying bag, particularly a backpack, comprising a receiving container for receiving objects to be transported, and a carrying device connected to the receiving container and comprising connection elements, the connection elements being lower and upper connection elements, wherein at least two connection elements are connected by a string line made from a material having a low-friction surface, said string line being a common pulling element, wherein movement of one portion of the string line causes movement of another portion of the string line, and wherein the carrying device is movable relative to the receiving container.

26. The carrying bag according to claim 25, wherein the string line is guided through a channel provided on the receiving container.

* * * * *